United States Patent [19]

Knabel

[11] Patent Number: 4,457,532

[45] Date of Patent: Jul. 3, 1984

[54] METHOD AND APPARATUS FOR THE ACTUATING BEHAVIOR OF SAFETY SKI BINDING

[75] Inventor: Walter Knabel, Farchant, Fed. Rep. of Germany

[73] Assignee: Marker-Patentverwertungsgesellschaft mbH., Baar, Switzerland

[21] Appl. No.: 337,257

[22] Filed: Jan. 5, 1982

Related U.S. Application Data

[63] Continuation-in-part of Ser. No. 190,859, Mar. 19, 1980, abandoned.

[30] Foreign Application Priority Data

Jul. 19, 1978 [DE] Fed. Rep. of Germany ..... 2831768

[51] Int. Cl.[3] ..... A63C 9/08

[52] U.S. Cl. ..... 280/612; 280/613

[58] Field of Search ..... 280/612, 613, 611

[56] References Cited

U.S. PATENT DOCUMENTS

| | | | |
|---|---|---|---|
| 3,907,316 | 9/1975 | Marker et al. | 280/612 |
| 4,135,733 | 1/1979 | Salomon | 280/612 |
| 4,160,555 | 7/1979 | Salomon | 280/612 |
| 4,291,894 | 9/1981 | D'Antonio et al. | 280/612 |
| 4,309,760 | 1/1982 | D'Antonio | 280/612 X |
| 4,387,307 | 6/1983 | D'Antonio | 280/612 X |

FOREIGN PATENT DOCUMENTS 2014935 10/1971 Fed. Rep. of Germany .

*Primary Examiner*—Joseph F. Peters, Jr.
*Assistant Examiner*—Michael Mar
*Attorney, Agent, or Firm*—D. Peter Hochberg

[57] ABSTRACT

A method and apparatus for automatically releasing a ski boot from a ski on which the ski boot is held by a ski binding. Circuitry is provided for continuously monitoring over a time integral the forces exerted by the ski on the leg of the skier. The monitored forces are compared with a characteristic threshold value representing a product of force × time, which lies above an integration threshold value corresponding to the holding force of the ski binding. The connection between the ski and boot is released when the monitored forces exceed the characteristic threshold value. The characteristic threshold value is varied independently of a static actuating force by varying the integration threshold value.

10 Claims, 6 Drawing Figures

METHOD AND APPARATUS FOR THE ACTUATING BEHAVIOR OF SAFETY SKI BINDING

This is a continuation-in-part of U.S. patent application Ser. No. 190,859, filed Mar. 19, 1980, now abandoned.

FIELD OF THE INVENTION

The invention relates to a method and apparatus for automatically releasing a ski boot from a ski in the event of danger.

BACKGROUND OF THE PRIOR ART

For the purpose of automatically releasing a ski boot from a ski, use has been made of safety ski bindings in which, when a pressure exceeding a given, possibly adjustable resistance comes into play, a ski boot holder moves from its locking positon to its releasing position, thus releasing the ski boot. Hitherto known ski safety bindings are triggered on the principle of a mechanical elasticity prescribed by a force/distance function. However, distance has proved to be a very critical and unreliable parameter which very decisively depends on environmental influences that have a large effect on friction. Kinematic design and choice of material also decide the actuating behaviour and thus the quality of the binding.

Of particular interest is U.S. Pat. No. 3,907,316 which issued on Sept. 23, 1975 to Marker et al. This patent relates to a method and a device for automatically releasing a ski boot from a ski on which the boot is mounted, in the event of danger to the skier. The forces acting in a skier's leg are continuously monitored and are compared, over a predetermined interval of time, with a threshold value. When the forces reach a predetermined value, related to the threshold value, the ski boot is released from the ski.

In this way U.S. Pat. No. 3,907,316, by introducing a characteristic releasing quantity 'pulse', is able to replace the mechanical elasticity by an electric elasticity which, in comparison with the former, has the advantage of being independent of distance and thus eliminating frictional influences and the like. This is associated with an accurate setting of the binding independent of external influences and remaining unchanged even during prolonged periods of operation.

Even though U.S. Pat. No. 3,907,316 represents a desirable improvement in the art, there is still a need for a method and apparatus for successfully operating an electronic safety ski binding under different marginal conditions such as skiing ability, bone structure of the skier, snow and terrain conditions. The present invention is directed toward filling this need.

SUMMARY OF THE INVENTION

The present invention relates to a method and apparatus for modifying the actuating behaviour of a safety ski binding so that in hazardous situations a ski boot is automatically released from a ski on which the ski boot is held by the binding. The method requires that, over a time integral, the forces exerted by the ski on the leg of the skier be detected according to U.S. Pat. No. 3,907,316, incorporated by reference herein, and, on reaching a threshold value (actuating characteristic curve) representing a product of force × time which lies above the integration threshold value corresponding to the holding force of the ski binding, the connection between the ski boot be released.

U.S. Pat. No. 3,907,316 for the first time describes a pulse as the characteristic actuating value for electronic safety ski bindings, the pulse being represented as the integral of the force transmitted between the ski boot and ski over the time for which it acts. This characteristic pulse curve extends above an integration threshold value represented by the static actuating force.

The present invention represents an improvement over U.S. Pat. No. 3,907,316 and has the object of adapting the electronic ski safety binding to different marginal conditions such as skiing ability and bone structure of the skier, as well as snow and terrain conditions. According to the invention, the actuating characteristic curve is varied independently of the static actuating force by varying the integration threshold value. In a development of the inventive concept, variation of the actuating characteristic curve can be effected by disposing the integration threshold value under the static actuating force or, according to a different embodiment, by varying the integration threshold value over time.

A logarithmic course of the integration threshold value over time may be selected for varying the actuating characteristic curve. By using other than logarithmic functions, practically any actuating characteristic curve can be produced. According to one feature of the invention, a synthetic curve shape produced by steps over time may be selected for varying the actuating characteristic curve.

Other features and advantages for the invention are apparent from the claims, the drawings and the following description.

DETAILED DESCRIPTION OF THE DRAWINGS

The present invention relates to an improvement over the method and apparatus for releasing a ski boot as presented in U.S. Pat. No. 3,907,316, issued Sept. 23, 1975 and incorporated by reference herein. Under the method of the present invention, the actuating behavior of a safety ski binding is modified so that, in hazardous situations, a ski boot is automatically released from a ski on which the boot is held by the binding. The forces exerted by the ski on the leg of the skier are continuously detected over time. If the time integral of the measured force reaches a threshold value representing a product force × time which lies above the integration threshold value corresponding to the holding force of the ski binding, the connection between the ski and boot is released.

Figure 1:
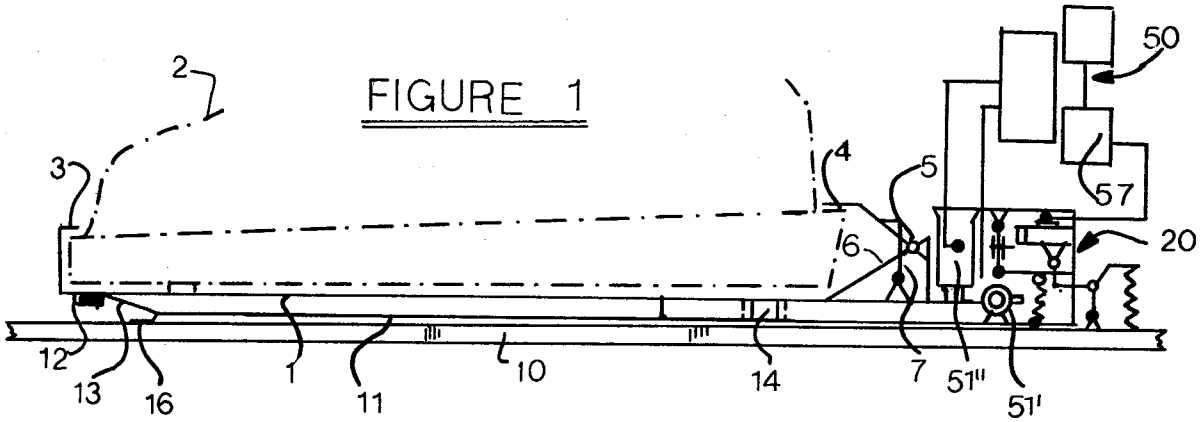
FIG. 1 shows a diagrammatic side view of a ski binding device embodying the teachings of the present invention.

A safety ski binding suitable for use in practising the inventive method is illustrated diagrammatically in FIG. 1. Because many of the details of the ski binding may be found in U.S. Pat. No. 3,907,316, only the details necessary to discuss the present invention are provided.

The binding has a sole plate 1 on which a ski boot 2 is held in any given suitable manner, being only arbitrarily detachable. A front sole holder 3 is held on the sole plate for adaptation to various boot sole lengths and thicknesses, both the height and length being adjustable. A rear sole holder 4 can pivot around a horizontal transverse axis 5 and is connected firmly to an entering pedal 6. A swivel bolt 7 is spring-loaded and can be swivelled to the right relative to FIG. 1, for example, by means of a ski pole tip against spring force, so that the sole holder 4 is released and ski boot 2 can be lifted off sole plate 1. When the ski boot is inserted into the binding, the rear sole end encounters entering pedal 6 and swivels the rear sole holder 4 to its locking position. Swivel bolt 7 then catches automatically. Ski boot 2 is then held quasirigidly on sole plate 1 and, as already mentioned, can be detached only arbitrarily from the sole plate.

The rear sole holder 4 is followed by the electronic pressure recording system which is designated by numeral 50 as a whole and described in detail with reference to FIG. 3.

Figure 2:
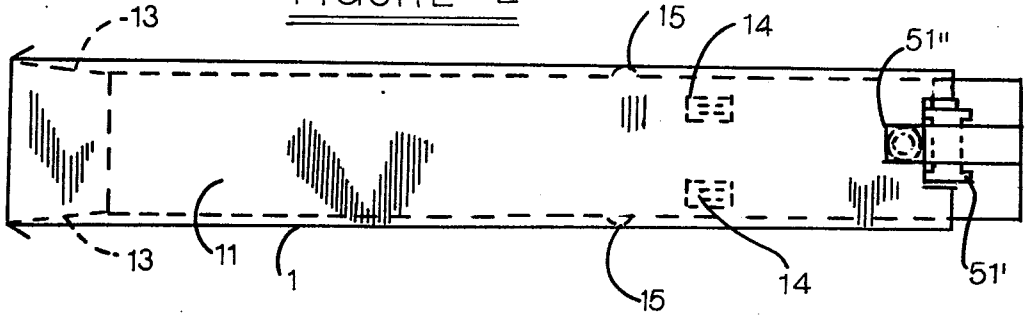
FIG. 2 is a diagrammatic top view of the device of FIG. 1.

The sole plate 1 is held on the ski via a base plate 11 that can be detached together with it from ski 1. The front end of the sole plate is equipped with a pocket 12 into which two swing arms 13 of the base plate 11 engage. The compressive forces perpendicular to the ski plane produce slight deformations whereas relatively great deformations are produced for forces horizontal to the ski plane. Roughly in the range of the rear ski boot and there is a connection between sole plate 1 and base plate 11 via two buffers 14. These buffers are so dimensioned in keeping with the swing arms that they too take up tensile and compressive forces perpendicular to the ski plane with slight deformations and forces horizontal to the ski plane with relatively large deformations. Sole plate 1 overlaps base plate 11 at least along the two long sides. Roughly in the range of the extension of the leg axis the turning centre between the two plates is formed in that base plate 11 has two lateral cams 15 (see FIG. 2) which are in spot-like contact with the longitudinal side walls of sole plate 1 which are drawn downwards. The transverse forces occurring during the travelling motion which do not cause the leg to twist can thus be picked up.

At its rear end, the base plate 11 bears a pressure recorder 51' of the electronic pressure recording system. In a preferred embodiment, the pressure recorder is a capacitive pick-up. The pick-up is in active contact with the rear end of sole plate 1, the contact being such that the torsion forces acting on the sole plate are recorded and measured by the pick-up. Interference quantities are practically eliminated in the torsion measurement by the above-mentioned dimensioning of swing arms 13 and buffers 14. The forces which act on sole holder 4 in a roughly vertical upward direction and occur on frontal loading are transmitted by sole plate 1 to a further pressure recorder 51'' which is likewise a capacitive pick-up. This pick-up is also connected firmly to base plate 11. The front end of the base plate 11 is held detachably on the ski surface by a ski fitting 16. The base plate is held with its rear end on the ski surface by a locking feature which is designated by numeral 20 as a whole and can be unlocked automatically in the event of danger. The details of the locking feature 20 are presented in the aforementioned U.S. Pat. No. 3,907,316.

Figure 3:
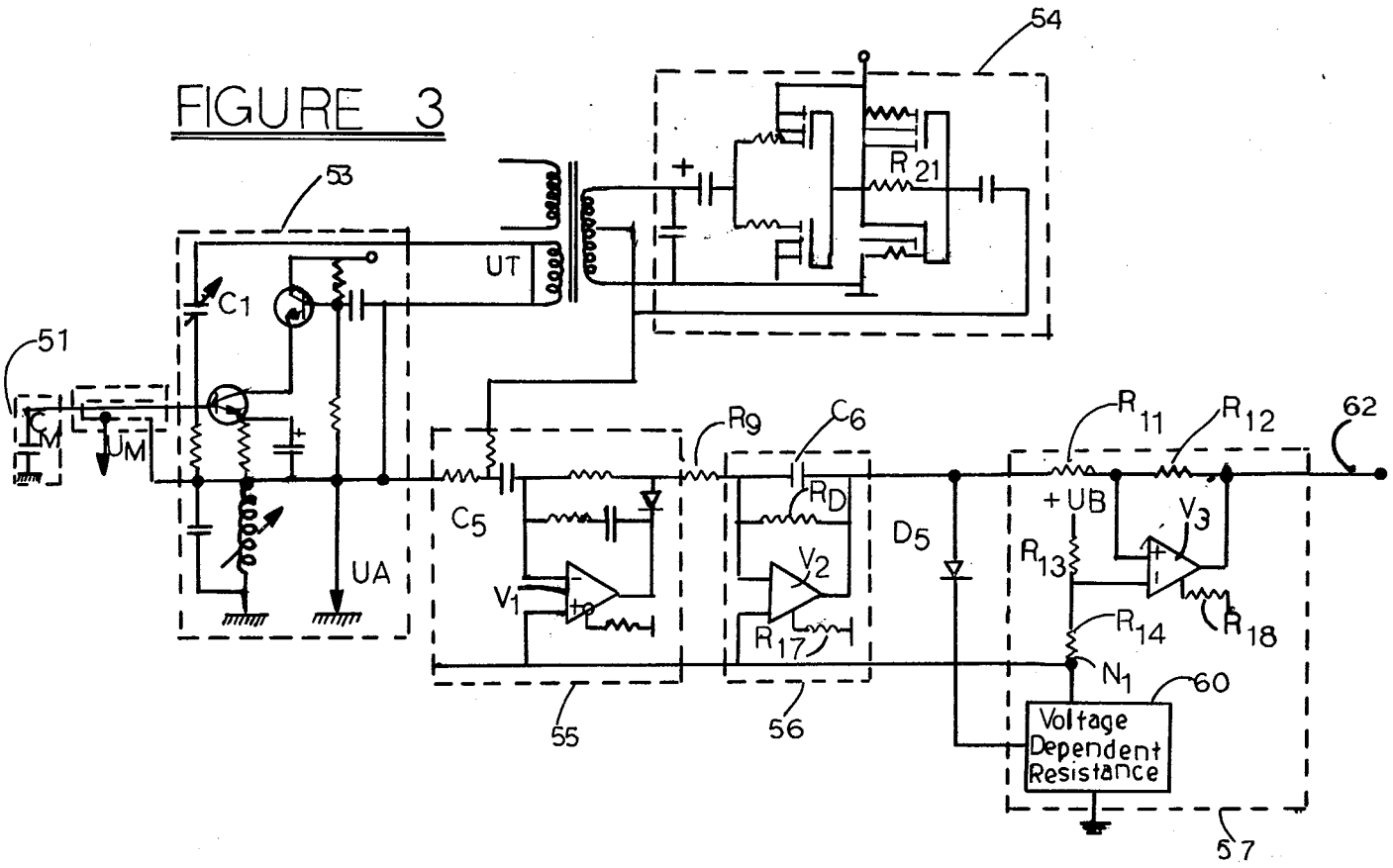
FIG. 3 is a schematic diagram of the circuitry forming part of the pressure recording system forming part of the device of FIG. 1.

The electronic pressure recording system according to FIG. 3 consists of the following groups: pressure recorder 51, transmission line 52, impedance transformer stage 53, arithmetic mean value generator 56 and threshold value switch 57. The electronic pressure recording system operates in the following manner.

The reactance of capacitive pressure recorder 51 is proportional to the plate spacing of the pick-up, i.e., the voltage across capacitor $C_M$ is proportional to the spacing of the pick-up plates and hence to the pressure when the current is impressed. The current is impressed in that a fixed voltage $U_T$ determines the current across capacitor $C_1$. In this case the output voltage $U_A$ of the impedance transformer 53 is almost equal to the voltage across $C_M$ with regard to frequency and amplitude. Output voltage $U_A$ is physically uncoupled and applied to the rectifier via capacitor $C_5$. In a rectifier stage 55 the AC voltage $U_A$ is rectified with the aid of a half-wave rectifier.

An arithmetic means value is formed via a low pass filter 56 having an adjustable time constant. This arithmetic mean value is the quantity which best describes the pressure and energy curve in the static and dynamic conditions. It is therefore employed for releasing purposes.

Behind stage 56 which forms the arithmetic mean value there is a threshold value switch 57, the reference potential of which fluctuates to the same degree with the operating voltage as the DC voltage component of the measured quantity, i.e., operating voltage fluctuations are thus balanced out directly. The output signal of threshold value switch 57 is directly employed for releasing purposes in the device described. However, it is also basically possible to order the output signal.

The details of the impedance transformer stage 53, the carrier frequency oscillator stage 54, and the rectifier stage 55 are presented in U.S. Pat. No. 3,907,316 and incorporated by reference herein.

The output signal of the rectifier stage 55 is transmitted to the arithmetic mean value generator 56 via resistor $R_9$. Capacitor $C_6$ and resistor $R_{10}$ form the feedback of operation amplifier $V_2$, the current consumption of which is adjusted with resistor $R_{17}$, the time constant of the mean value generator being adjustable within wide limits via capacitor $C_6$ and resistor $R_{10}$.

The working point of amplifiers $V_1$ and $V_2$ as well as the switching point of amplifier $V_3$ are constantly adjusted together via the voltage divider formed by resistors $R_{13}$, $R_{14}$ and voltage dependent resistance 60. Resistor $R_{12}$ serves as feedback resistance for the threshold value switch, this resistor thereby governing the hysteresis of the threshold value switch in conjunction with resistor $R_{11}$. The current consumption of amplifier $V_3$ is adjusted via resistor $R_{18}$.

Further details of the way in which the integration threshold value is varied will now be described. The arithmetic mean value generator 56 produces at its output the steering signals presented to the threshold value switch 57 in order to enable the switch to produce signal at its output 62 to actuate the ski binding release. The value of the integration threshold is determined by the voltage divider of $R_{13}$, $R_{14}$ and voltage dependent resistance 60. If resistance 60 is varied, then the integration threshold value appears at the node $N_1$, which is the common connection point for one end of resistor $R_{14}$ and one end of voltage dependent resistance 60.

Thus, a signal is taken from the output of the arithmetic mean value generator 56 passed through a diode $D_5$ to provide an input into the voltage dependent resistance 60. By way of example, the voltage dependent resistance 60 may take the form of a field effect transistor with its drain being connected to node $N_1$, its source being connected to ground, and its gate receiving the steering signal passing through diode $D_5$.

As has been pointed out before, the arithmetic mean value generator 56 is a low pass filter (sometimes called a lag network). The input to generator 56 is single-sided by virtue of the rectifier function of stage 55. The low pass filter functions to provide the crucial time delay to the release signal in the binding. This delay, of course, avoids the release action based on a force magnitude alone, since the important release criteria must be based on the energy absorbed by the bone, that is, both the magnitude and time of the applied force. The low pass filter actually produces a hyperbolic response which is desired and which will be described in further detail hereinafter when making reference to the specific operation of the elements just described.

The voltage taken between resistor $R_{14}$ and voltage dependent resistance 60 at node $N_1$ is connected to the non-inverting port of amplifiers $V_2$ and $V_1$. Such a connection places those amplifiers in a differential mode of operation and is intended to show that neither the rectifier 55 nor the low pass filter 56 is active until the magnitude of the input signal exceeds the threshold value represented by this voltage level.

During skiing, the forces of torsion and of a frontal fall acting on the skier's leg are measured continuously, the paths being practically zero because the very slight necessary measuring paths for pressure recorders 51' and 51" are smaller than the elastic material deformations of plates 1 and 11 and of ski boot 2. The pulses acting on the skier's leg are thus picked up constantly. As mentioned in conjunction with the description of the electronic pressure recording system, these pulses are constantly compared with a predetermined pulse quantity formed by the constantly varying threshold value. When this threshold value is reached, threshold value switch 57 emits a pulse as a control instruction for unlocking.

Figure 4:
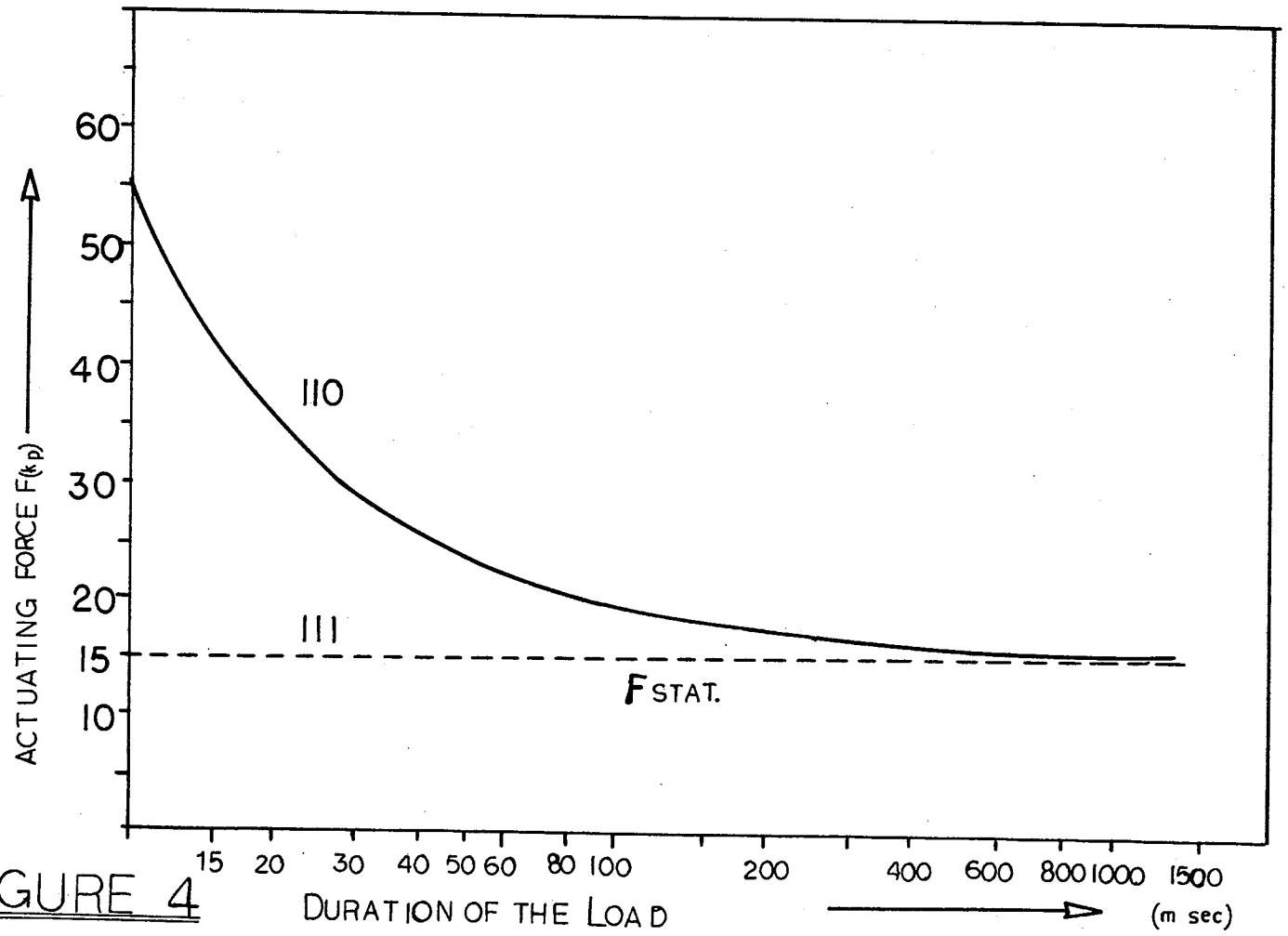
FIG. 4 shows the actuating characteristic curve of an electronic ski safety binding according to the pulse method.

Turning now to FIG. 4, the actuating characteristic of an electronic safety ski binding operating according to the U.S. Pat. No. 3,907,316 is illustrated. The actuating force of the binding is plotted against the duration of the load, and the same applies to FIGS. 5 and 6 to be described hereinafter. The actuating force F is given in [kp] and the duration t of the load in [msec].

The actuating curve is shown at 110 as a time integral of the force (pulse). In the example, the pulse I=0.2 kp sec. The actuating curve 110 asymptotically approaches an integral threshold value 111 which, in the example, corresponds to $F_{stat.}$=15 kp of the static holding force of the binding. Only those forces are integrated which lie above the integral threshold value 111 so that, even for prolonged loads roughly corresponding to the size of the control forces for a ski, no actuation of the binding will take place.

Figure 5:
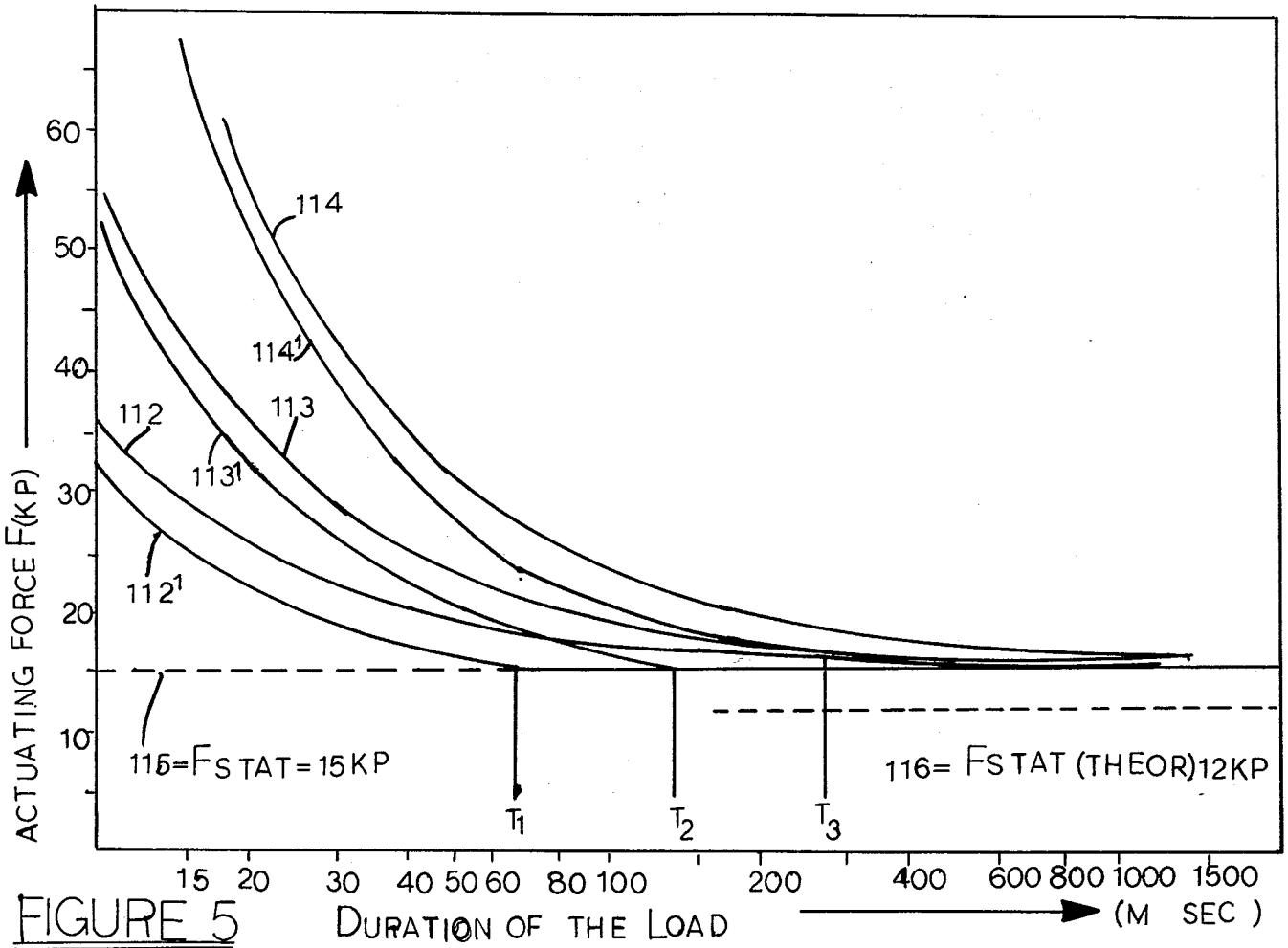
FIG. 5 shows the actuating characteristic curves of an electronic ski safety binding according to the pulse method, wherein the curves are varied by differentiating the integration threshold value from the static actuating force.

In FIG. 5, three different actuating characteristic curves are represented at 112, 113 and 114 with $I_{12}$=100 kp msec, $I_{13}$=200 kp msec and $I_{14}$=400 kp msec with asymptotically approach the static releasing force 115 with F=15 kp. These curves were modified by differentiating between the integration threshold value 116=$F_{stat.}$ (theor.) and the static actuating force 115=$F_{stat.}$, thereby producing the actuating curves 112', 113' and 114' which rise more steeply especially during longer periods of being effective, the size of the pulses being equal to those of the curves 112, 113 and 114. The curve 112' enters the static actuating force 115 ($F_{stat.}$=15 kp) at T1, the curve 113' at T2 and the curve 114' at T3. Thus, with the aid of the modified curves, one can advantageously determine as from which duration of the load the purely static actuation is to be employed. For the modified curves 112', 113' and 114', the line 116 with F=12 kp is applicable as the integration threshold value.

Figure 6:
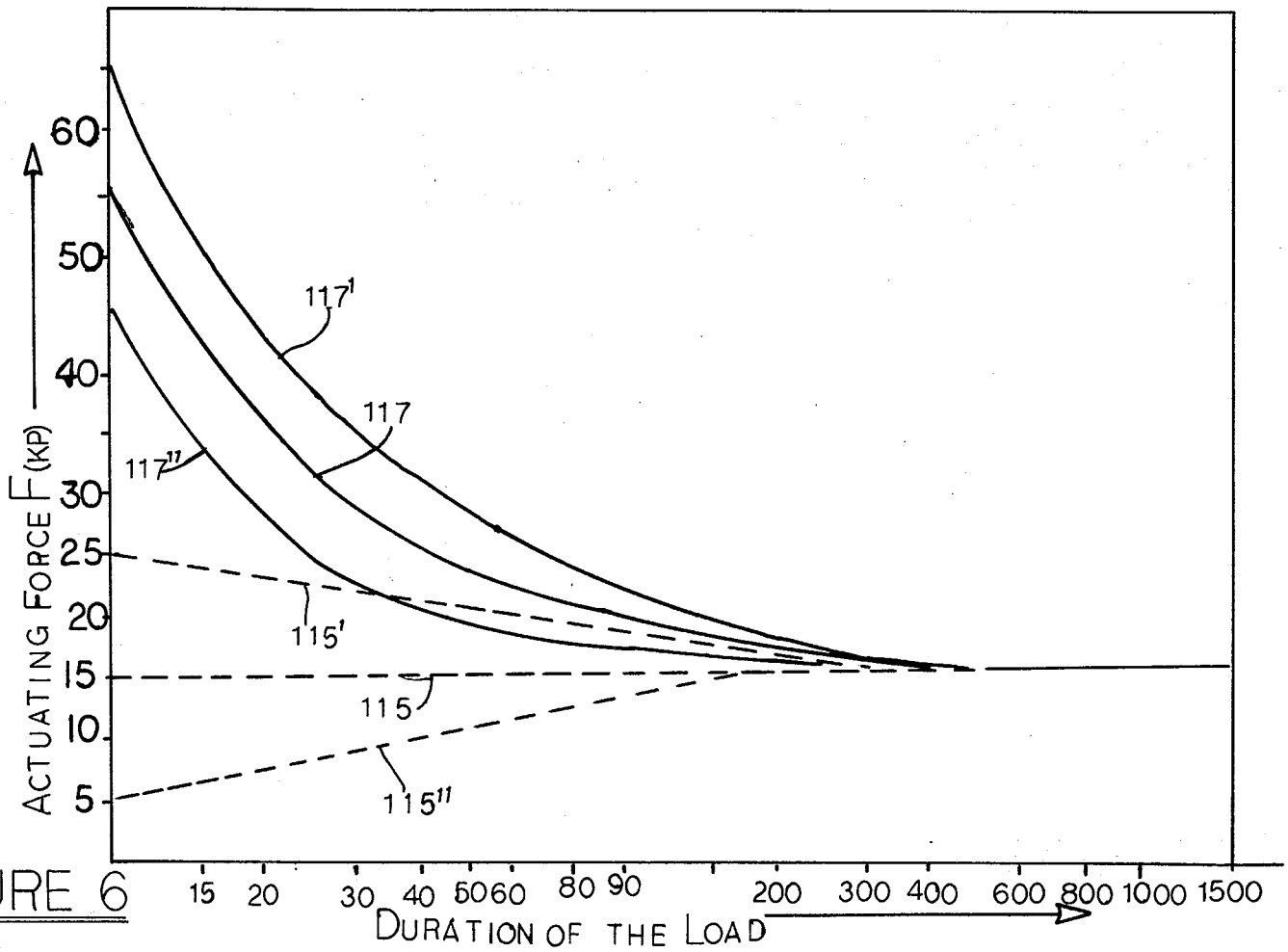
FIG. 6 shows the actuating characteristic curves of an electronic ski safety binding according to the pulse method with variation of the integral threshold value over time at a constant $F_{stat}$.

FIG. 6 shows a different method for varying the actuating characteristic curve, namely by varying the integration threshold value over the time through the use of the voltage dependent resistance 60. The actuating curve 117 with I=200 kp msec is constructed according to the approach mentioned in the context of FIG. 3 and asymptotically approaches the integration threshold value 115 corresponding to the static actuating force.

The actuating characteristic line 117' with I=200 kp msec is for example produced with the integration threshold value 115' of 25 kp at T=10 msec following a logarithmic curve to drop to 15 kp (static actuating force) at T=200 msec. This raises the actuating characteristic value particularly during short periods. A reduction in the actuating characteristic value for short periods can be produced by the reverse procedure, which leads to the actuating characteristic curve 117". Here the threshold value 115" at T=10 msec is for example set at 5 kp and rises likewise along a logarithmic curve, to 15 kp (static actuating force) at T=200 msec. By employing other than logarithmic relationships over time, one can produce practically any actuating characteristic curves. For example, it is conceivable to have a synthetic curve shape for the threshold value that is produced by steps.

The methods here described are clearly not restricted to the numerical values given in the examples but are applicable to any desired values.

Although the present invention has been shown and described in terms of a specific preferred embodiment, it will be appreciated by those skilled in the art that changes or modifications are possible which do not depart from the inventive concepts described and taught herein. Such changes and modifications are deemed to fall within the purview of these inventive concepts.

What is claimed is:

1. A method of automatically releasing a ski boot from a ski on which the ski boot is held by a ski binding, said method comprising the steps of:

generating electrical force signals corresponding to forces exerted by the ski on the leg of the skier;

processing those of said force signals exceeding an integration threshold value, said integration threshold value being a minimum value at which said force signals will be processed to generate monitored signals whose values are a function of the magnitude and duration of said force signals;

comparing said monitored forces with a characteristic release threshold value representing a predetermined function of magnitude and duration, said characteristic release threshold value being a function of said integration threshold value;

releasing the connection between the ski and boot, when the monitored forces exceed the characteristic release threshold value; and varying said characteristic release threshold value independently of a static actuating force by varying the integration threshold value, said static actuating force being a force which exceeds a minimum magnitude required for releasing the connection between the ski and the boot.

2. The method according to claim 1, wherein said integration threshold value lies under said static actuating force.

3. The method according to claim 1, wherein the variation of the characteristic release threshold value takes place by varying the integration threshold value over time.

4. The method according to claim 1, wherein said characteristic release threshold value is varied over time according to a preselected logarithmic course.

5. The method according to claim 1, wherein said characteristic release threshold value is varied over a synthetic curve formed from a plurality of steps.

6. A device for automatically releasing a ski boot from a ski on which the ski boot is held by a ski binding, said device comprising:

means for generating electrical force signals corresponding to forces exerted by the ski on the leg of the skier;

means for processing those of said force signals exceeding an integration threshold value, said integration threshold value being a minimum value at which said force signals will be processed to generate monitored signals whose values are a function of the magnitude and duration of said force signals;

means for comparing said monitored forces with a characteristic release threshold value representing a predetermined function of magnitude and duration, said characteristic release threshold value being a function of said integration threshold value;

means for releasing the connection between the ski and boot, when the monitored forces exceed the characteristic release threshold value; and means for varying said characteristic release threshold value independently of a static actuating force by varying the integration threshold value, said static actuating force being a force which exceeds a minimum magnitude required for releasing the connection between the ski and the boot.

7. The device according to claim 6, wherein said integration threshold value lies under said static actuating force.

8. The device according to claim 6, wherein said means for varying includes means for varying the integration threshold value over time.

9. The method according to claim 6, wherein said means for varying includes means for varying said characteristic release threshold value over time according to a preselected logarithmic course.

10. The method according to claim 6, wherein said means for varying includes means for varying said characteristic release threshold value over a synthetic curve formed from a plurality of steps.

* * * * *